US009417574B2

(12) United States Patent
Nakai

(10) Patent No.: US 9,417,574 B2
(45) Date of Patent: Aug. 16, 2016

(54) HEATER AND METHOD OF FORMING A HEATER

(71) Applicant: Alps Electric Co., Ltd., Tokyo (JP)

(72) Inventor: Takashi Nakai, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/883,247

(22) Filed: Oct. 14, 2015

(65) Prior Publication Data

US 2016/0116873 A1 Apr. 28, 2016

(30) Foreign Application Priority Data

Oct. 23, 2014 (JP) ..... 2014-216010

(51) Int. Cl.

| | |
|---|---|
| ***G03G 15/20*** | (2006.01) |
| ***H05B 3/00*** | (2006.01) |
| ***H05B 3/03*** | (2006.01) |
| ***H05B 3/06*** | (2006.01) |
| ***H05B 3/20*** | (2006.01) |

(52) U.S. Cl.

CPC ..... *G03G 15/2053* (2013.01); *H05B 3/0014* (2013.01); *H05B 3/03* (2013.01); *H05B 3/06* (2013.01); *H05B 3/20* (2013.01)

(58) Field of Classification Search

CPC ..... G03G 15/2053; G03G 2215/2035; H05B 3/0014; H05B 3/03; H05B 3/06; H05B 3/20

See application file for complete search history.

(56) References Cited

U.S. PATENT DOCUMENTS

| | | | | |
|---|---|---|---|---|
| 5,753,889 | A * | 5/1998 | Kondo | G03G 15/2064 219/216 |
| 5,774,776 | A | 6/1998 | Takada et al. | |
| 2014/0021195 | A1* | 1/2014 | Kim | H05B 3/84 219/553 |
| 2014/0169845 | A1* | 6/2014 | Nakahara | G03G 15/2053 399/328 |

FOREIGN PATENT DOCUMENTS

| | | |
|---|---|---|
| JP | 2560461 | 9/1996 |

* cited by examiner

*Primary Examiner* — Rodney Bonnette
(74) *Attorney, Agent, or Firm* — Brinks Gilson & Lione

(57) ABSTRACT

A heater includes a heater unit and a holder. The heater unit includes a flat and smooth substrate, a linear heat generator provided on a first surface of the substrate, a plurality of electrodes that supply power to the heat generator, and a protective layer disposed to cover a part of each of the electrodes and the heat generator. A second surface of the substrate is bonded to the holder. The substrate is formed of a transparent material. A plurality of positioning marks for determining the relative positions of the heater unit and the holder are disposed on the first surface of the substrate. The holder has through-holes formed at positions opposite to the positioning marks.

14 Claims, 10 Drawing Sheets

HEATER AND METHOD OF FORMING A HEATER

CLAIM OF PRIORITY

This application claims benefit of priority to Japanese Patent Application No. 2014-216010 filed on Oct. 23, 2014, which is hereby incorporated by reference in its entirety.

BACKGROUND OF THE DISCLOSURE

1. Field of the Invention

The present disclosure relates to a heater used as a heat source of a toner fixing device in a copying machine or the like.

2. Description of the Related Art

In recent years, a heater having a linear heat generator, having a low heat capacity, has been used as a heat source of a toner fixing device in a copying machine, an electro-photographic printer, or the like. A toner fixing device in which such a heater is incorporated has the advantage of achieving power saving and a reduction in wait time compared to a toner fixing device employing a heat roller system, a heat plate system, a flash fixing system, an oven fixing system, or the like.

Examples of such heaters include a heating element of a fixing device described in Japanese Unexamined Patent Application Publication No. 2-157886, and a heating element of a fixing device described in Japanese Unexamined Patent Application Publication No. 9-068877.

The heating element 820 described in Japanese Unexamined Patent Application Publication No. 2-157886 will be described below with reference to FIG. 13. FIG. 13 is a plan view showing the configuration of the heating element 820.

As shown in FIG. 13, the heating element 820 includes a heater body 821*a* and a heater body holding member 820*a*. The heater body 821*a* includes an alumina substrate 821, a heat generator 822 made of silver-palladium (Ag/Pd) that is formed substantially in the center of the surface of the alumina substrate 821 along the longitudinal direction by screen printing in a linear or band-like shape, and a wear-resistant material such as glass. The temperature of a fixing nip part corresponding to the heat generator 822 is maintained and controlled at a predetermined fixing temperature. Using a side wall surface 820*k* of a horizontally long slot 820*b* of the heater body holding member 820*a* as a surface reference K, the heater body 821*a* is fitted into the slot 820*b* with a longitudinal side wall surface 821*k* of the alumina substrate 821 in close contact with the surface reference K, and is integrally attached to and held by the heater body holding member 820*a*. Owing to the surface reference K, the heat generator 822 can be positioned.

In the fixing device described in Japanese Unexamined Patent Application Publication No. 9-068877, in order to improve the positional precision, the following structure is discussed. The fixing device 911 described in Japanese Unexamined Patent Application Publication No. 9-068877 will be described below with reference to FIGS. 14 and 15. FIG. 14 is a sectional view showing the schematic configuration of the fixing device 911. FIG. 15 is a bottom view showing a heater substrate 922 of the heating element 920 of the fixing device 911.

As shown in FIG. 14, the fixing device 911 includes a fixing film 925, a moving driving means for the fixing film 925, the heating element 920, and a pressure roller 928. The heating element 920 includes a heater support 921 and the heater substrate 922. The heater substrate 922 is a flat plate formed of alumina, aluminum nitride, or the like, and is embedded in the heating element 920. The heating element 920 and the pressure roller 928 are disposed opposite to each other with the fixing film 925 interposed therebetween. As shown in FIG. 15, the heater substrate 922 is provided with a heat generator 923 formed integrally with electrodes 931, and marks 930 for position adjustment of the heat generator. The heat generator 923 and the marks 930 for position adjustment of the heat generator are printed patterns formed by collective printing using the same printing plate.

However, if the positional precision of the linear heat generator is low, toner disposed on a recording material cannot be heated appropriately. In the case of the heating element 820 of the fixing device described in Japanese Unexamined Patent Application Publication No. 2-157886, the positional precision of the heat generator 822 may be deteriorated owing to the processing variation of the heater body holding member 820*a* and the processing variation of the alumina substrate 821. In the case of the fixing device 911 described in Japanese Unexamined Patent Application Publication No. 9-068877, the heat generator 923 and the electrodes 931 are often covered with a protective layer in order to secure durability and insulation thereof. When a protective layer is formed over the marks 930 for position adjustment of the heat generator, the outlines of the marks 930 for position adjustment of the heat generator may not be clearly visible. In particular, when the protective layer is formed by screen printing, surface roughness due to a mesh of a printing plate is left on the surface, therefore light is scattered, the outlines of the marks 930 for position adjustment of the heat generator are not clearly visible, and highly precise positioning is difficult. Therefore, with such a structure of the heat generator, highly precise positioning cannot be performed easily.

SUMMARY

In an aspect of the present invention, a heater includes a heater unit and a holder. The heater unit includes a flat and smooth substrate, a linear heat generator provided on a first surface of the substrate, a plurality of electrodes configured to supply power to the heat generator, and a protective layer disposed to cover a part of each of the electrodes and the heat generator. A second surface of the substrate is bonded to the holder. The holder is attached to an external device. The substrate is formed of a transparent material. A plurality of positioning marks for determining relative positions of the heater unit and the holder are disposed on the first surface. The holder has through-holes formed at positions opposite to the positioning marks.

This configuration makes it possible to observe the positioning marks provided on the first surface of the substrate formed of a transparent material through the through-holes of the holder. In addition, since the substrate is flat and smooth, and the interface between each positioning mark and the substrate is flat and smooth, the positioning marks are clearly visible without being affected by the scattering of light when the positioning marks formed on the first surface of the substrate is viewed from the second surface. The precision of positioning when incorporating the heater into the external device is thereby improved.

DESCRIPTION OF THE EXEMPLARY EMBODIMENTS

First Embodiment

Figure 1:
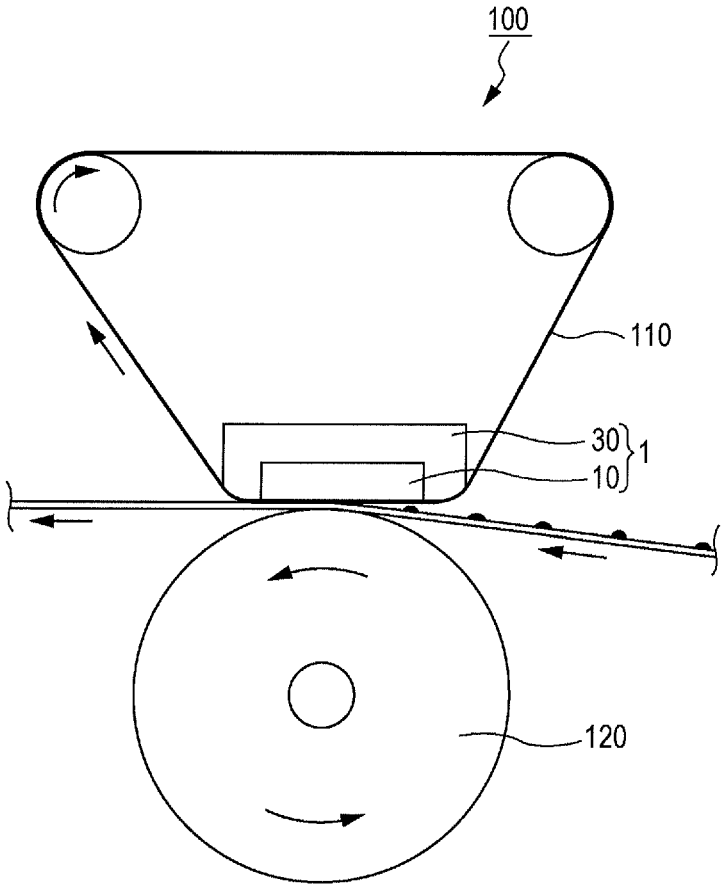
FIG. 1 is a schematic sectional view showing the configuration of an external device to which a heater of a first embodiment of the present invention is attached.

Embodiments of the present invention will now be described in detail with reference to the drawings. For ease of understanding, dimensions are changed in the drawings.

Figure 2:
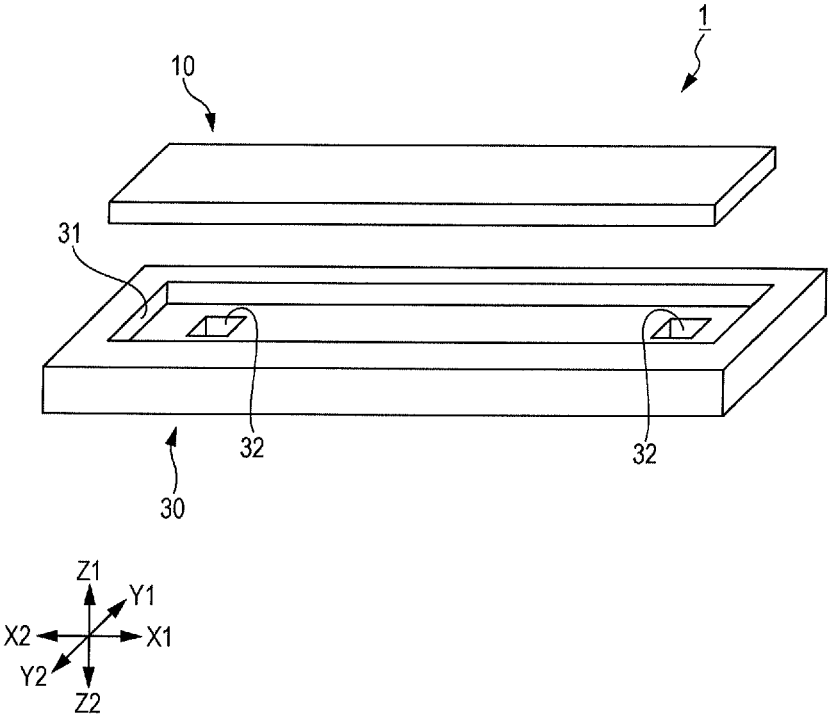
FIG. 2 is an exploded perspective view schematically showing the heater of the first embodiment of the present invention.
Figure 3:
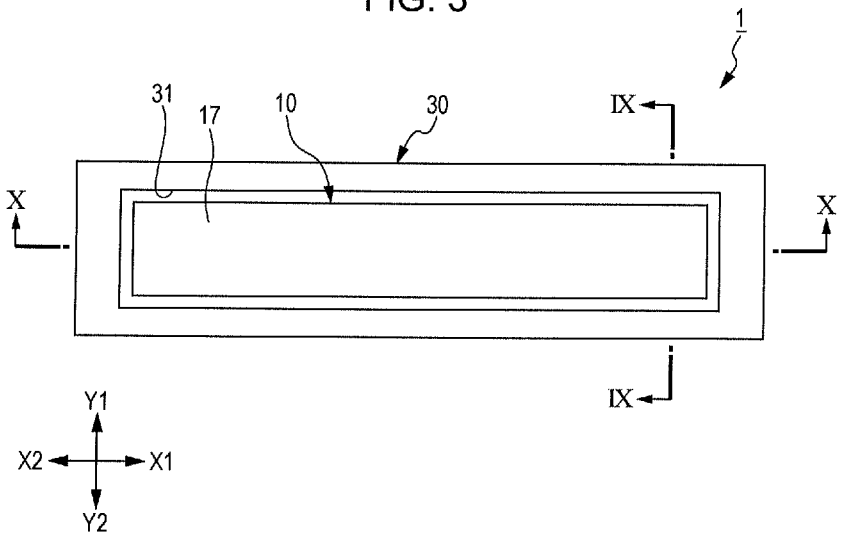
FIG. 3 is a schematic plan view showing the heater as viewed from the Z1 direction shown in FIG. 2.
Figure 4:
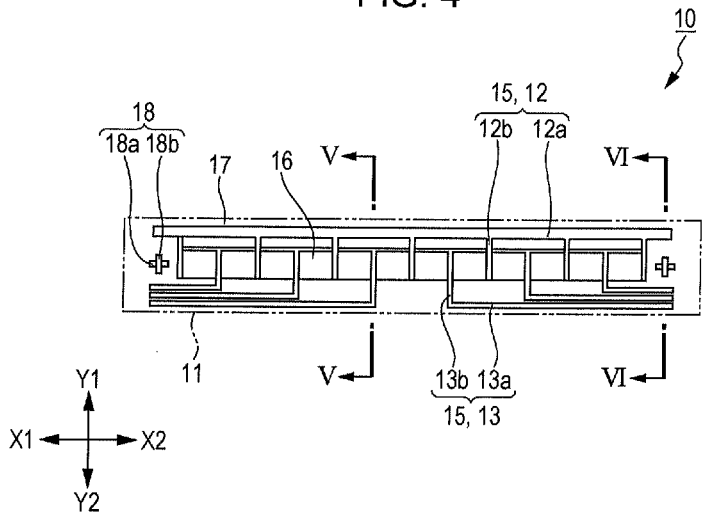
FIG. 4 is a schematic bottom view illustrating the arrangement of a heating element, electrodes, and a protective layer that are visible through a substrate when a heater unit is viewed from the Z2 direction shown in FIG. 2.
Figure 5:
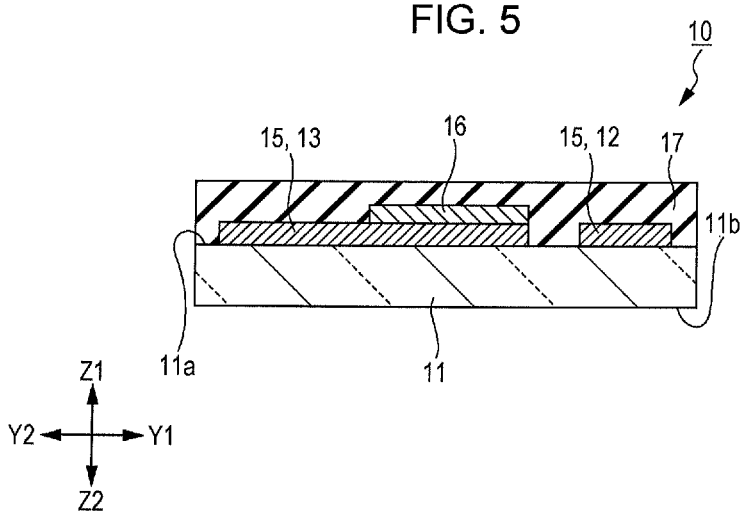
FIG. 5 is a schematic sectional view showing the heater unit taken along line V-V of FIG. 4.
Figure 6:
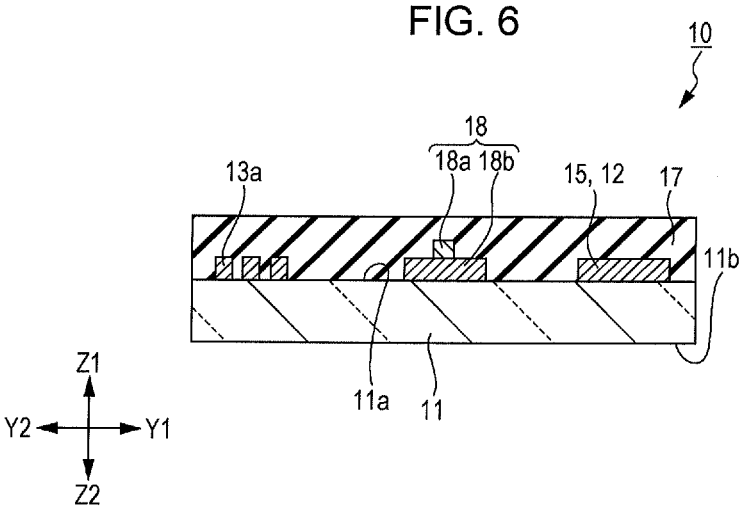
FIG. 6 is a schematic sectional view showing the heater unit taken along line VI-VI of FIG. 4.
Figure 7:
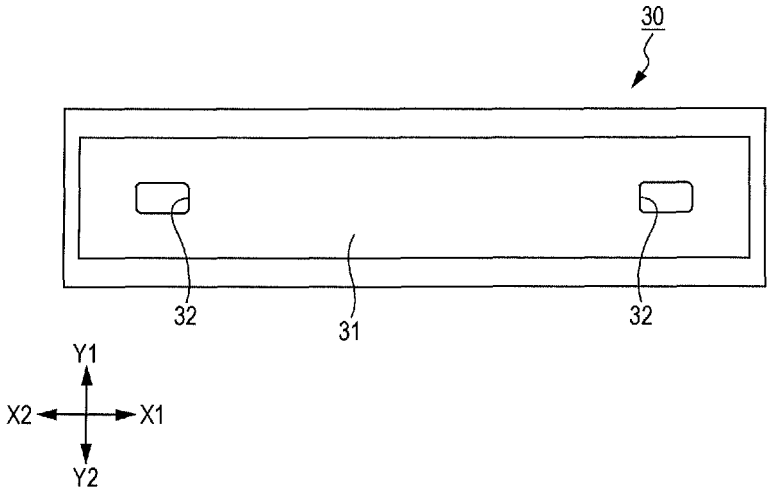
FIG. 7 is a schematic plan view showing a holder as viewed from the Z1 direction shown in FIG. 2.
Figure 8:
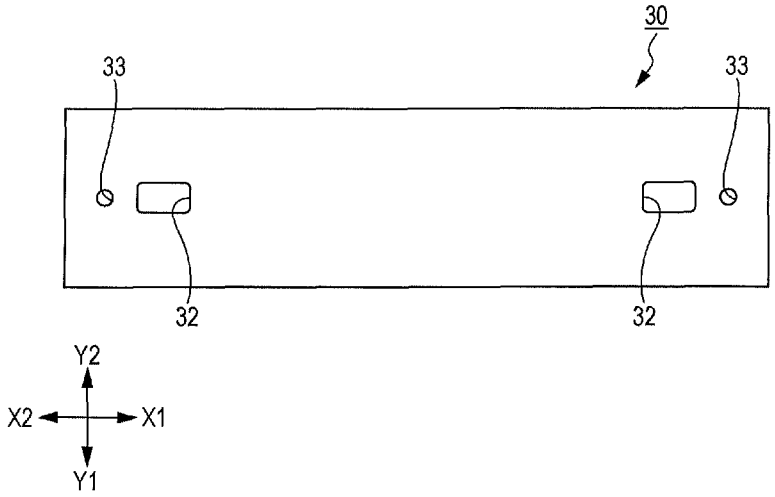
FIG. 8 is a schematic bottom view showing the holder as viewed from the Z2 direction shown in FIG. 2.
Figure 9:
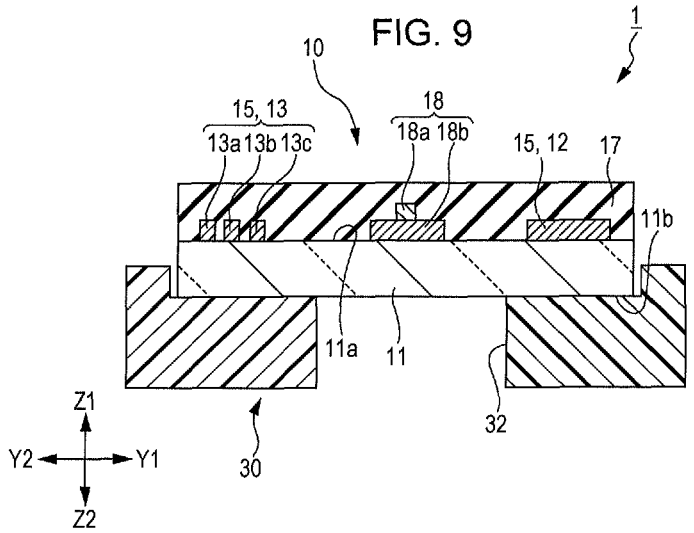
FIG. 9 is a schematic sectional view showing the heater taken along line IX-IX of FIG. 3.
Figure 10:
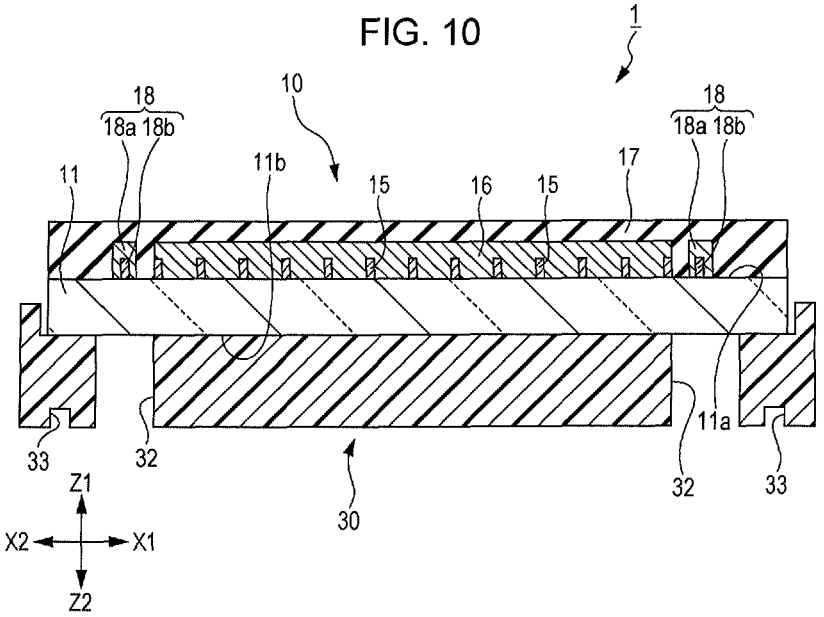
FIG. 10 is a schematic sectional view showing the heater taken along line X-X of FIG. 3.

FIG. 1 is a schematic sectional view showing the configuration of an external device 100 to which a heater 1 of a first embodiment of the present invention is attached. FIG. 2 is an exploded perspective view schematically showing the heater 1 of the first embodiment of the present invention. FIG. 3 is a schematic plan view showing the heater 1 as viewed from the Z1 direction shown in FIG. 2. FIG. 4 is a schematic bottom view illustrating the arrangement of a heating element 16, electrodes 15, and a protective layer 17 that are visible through a substrate 11 when a heater unit 10 is viewed from the Z2 direction shown in FIG. 2. FIG. 5 is a schematic sectional view showing the heater unit 10 taken along line V-V of FIG. 4. FIG. 6 is a schematic sectional view showing the heater unit 10 taken along line VI-VI of FIG. 4. FIG. 7 is a schematic plan view showing a holder 30 as viewed from the Z1 direction shown in FIG. 2. FIG. 8 is a schematic bottom view showing the holder 30 as viewed from the Z2 direction shown in FIG. 2. FIG. 9 is a schematic sectional view showing the heater 1 taken along line IX-IX of FIG. 3. FIG. 10 is a schematic sectional view showing the heater 1 taken along line X-X of FIG. 3. In these figures, a connecting part with an external power source is omitted.

As shown in FIG. 1, the heater 1 of the first embodiment of the present invention is attached for use to the external device 100 that is a toner fixing device. The external device 100 includes the heater 1, a belt 110, and a pressure roller 120. As shown in FIGS. 2 and 3, the heater 1 includes the heater unit 10 and the holder 30. The toner fixing device applies heat and pressure to toner disposed on recording paper, thereby fixing the toner on the recording paper. The external device 100 is configured such that the belt 110 moves with the rotation of the pressure roller 120. By being pressed against the heater unit 10, the belt 110 is heated, and fixes the toner on the recording paper.

By controlling the heat generation of the heater unit 10 in a desired state just before the toner disposed on the recording paper is nipped between the pressure roller 120 and the belt 110, power can be saved.

The heater unit 10 of the heater 1 is housed in a slot 31 formed in the holder 30, is positioned as described later, and is then fixed. The planar dimension of the slot 31 is larger than the dimension of the heater unit 10 so that the position adjustment of the heater unit 10 can be performed. For example, adhesive is used for fixing the heater unit 10, and the Z2 side surface of the heater unit 10 and the opposite surface of the slot 31 of the holder 30 are bonded together with the adhesive. Only part of the heater unit 10 may be bonded. So, for example, part of the opposite surface along the outer periphery of the heater unit 10 may be bonded without bonding the central part of the heater unit 10. In this case, a recess may be provided in the central part of the slot 31 so that a space is provided between the central part of the slot 31 and the Z2 side surface of the heater unit 10. In the following description, the Z1 side of FIG. 2 will be referred to as "the upper side," and the Z2 side of FIG. 2 will be referred to as "the lower side." This is only for ease of understanding of the description, and "the upper side" and "the lower side" in the following description are different from those in the usage state shown in FIG. 1.

As shown in FIGS. 4 to 6, the heater unit 10 includes the flat and smooth substrate 11, the plurality of electrodes 15, the linear heat generator 16, the protective layer 17, and positioning marks 18.

The substrate 11 is a flat plate-like insulator formed of a transparent material, and has heat resistance. The substrate 11 is preferably formed of glass.

The electrodes 15 are conductors formed by firing a conductive coating film patterned by screen printing on a first surface 11*a* of the substrate 11. The electrodes 15 are preferably formed of a highly conductive material such as silver, gold, or copper. The electrodes 15 include a comb-shaped electrode 12 and L-shaped electrodes 13. The electrodes 15 are connected to a power source (not shown) at the ends thereof, and supply power supplied from the power source to the heat generator 16.

The heat generator 16 is a resistor that generates heat when supplied with power. The heat generator 16 has a rectangular shape. The heat generator 16 is formed by forming a resistor coating film by screen printing on the first surface 11*a* of the substrate 11 on which the electrodes 15 are formed, and firing the resistor film. The heat generator 16 is preferably formed of an electric resistance material such as RuO2 or Ag/Pd.

As shown in FIG. 4, the comb-shaped electrode 12 includes a comb-shaped electrode 12*a* provided parallel to the long side of the heat generator 16 and comb-shaped electrodes 12*b* provided perpendicularly to the long side of the heat generator 16. The comb-shaped electrode 12*a* is disposed a predetermined distance apart from the heat generator 16 in the Y1 direction of the heat generator 16. The comb-shaped electrodes 12*b* are disposed at regular intervals in the longitudinal direction of the heat generator 16. The L-shaped electrodes 13 each include an L-shaped electrode 13*a* provided parallel to the long side of the heat generator 16 and an L-shaped electrode 13*b* provided perpendicularly to the long side of the heat generator 16. The L-shaped electrodes 13*a* are disposed apart from the heat generator 16 in the Y2 direction of the heat generator 16. The L-shaped electrodes 13*b* are disposed at regular intervals in the longitudinal direction of the heat generator 16 between the comb-shaped electrodes 12*b*. In the example shown in FIG. 4, the heat generator 16 is divided into six parts. However, the present invention is not limited to this, and the heat generator 16 may be divided into any number of parts.

Thus, current when power is supplied from the power source flows between the comb-shaped electrodes 12*b* and the L-shaped electrodes 13*b*, and causes the heat generator 16 to generate heat. In other words, the heat generating area of the heat generator 16 is determined by the arrangement of the electrodes 15 and which of the L-shaped electrodes 13*b* are supplied with power. For example, only part of the heating area can be caused to generate heat according to the width of the recording paper, or according to the area where toner is disposed.

The positioning marks 18 each include a first positioning mark 18*a* formed in the same step as the heat generator 16 and a second positioning mark 18*b* formed in the same step as the electrodes 15. As shown in FIG. 4, the positioning marks 18 are disposed apart from the comb-shaped electrodes 12*b* and the L-shaped electrode 13*b* located at both longitudinal ends of the heat generator 16, one on each side of the heat generator 16. The first positioning mark 18*a* and the second positioning mark 18*b* are provided so as to crisscross in directions parallel to and perpendicular to the longitudinal direction of the heat generator 16.

In this embodiment, the step of forming the electrodes 15 and the second positioning marks 18*b* on the first surface 11*a* of the substrate 11 is performed, and then, the step of forming the heat generator 16 and the first positioning marks 18*a* is performed. As shown in FIG. 5, at positions where the electrodes 15 are formed on the first surface 11*a* of the substrate 11, the heat generator 16 is formed on the upper side (Z1 side) of the electrodes 15. As shown in FIG. 6, at positions where the second positioning marks 18*b* are formed, the first positioning marks 18*a* are formed on the upper side (Z1 side) of the second positioning marks 18*b*.

The protective layer 17 is a thick film of insulator formed by firing a coating film formed of inorganic paste containing particles by screen printing. The protective layer 17 is formed, for example, of a glass material, and is a thick film containing 0.1 wt % to 30 wt % of hard glass particles having a particle diameter of 0.1 μm to 10 μm. The main component of the protective layer 17 and the size and amount of particles included in the protective layer 17 are not limited to this. As shown in FIGS. 5 and 6, the protective layer 17 is formed on substantially the entire first surface 11*a* of the substrate 11 so as to cover the electrodes 15, the heat generator 16, and the positioning marks 18. The ends of the electrodes 15 are exposed from the protective layer 17 so that they can be electrically connected with the power source (not shown).

Since part of the protective layer 17 on the heat generator 16 is heated to a high temperature by the heat generation of the heat generator 16, the protective layer 17 has to be formed of a highly heat-resistant material. In addition, since temperature distribution is produced, the protective layer 17 preferably has a low thermal expansion coefficient and resistance to thermal stress. Further, since the heater 1 is attached for use to the external device 100 that is a toner fixing device as shown in FIG. 1, the protective layer 17 is preferably has wear resistance in contact with the belt 110.

Since, in this embodiment, the protective layer 17 contains particles, the physical properties of the protective layer 17 can be modified. For example, in order to improve wear resistance, hard glass particles or alumina particles can be included. By including particles, the thermal expansion coefficient can be adjusted.

Owing to surface roughness caused by a mesh of a printing plate when the protective layer 17 is formed by screen printing, light is scattered by the surface when the protective layer 17 is viewed from the Z1 direction, the protective layer 17 is visually white and opaque, and therefore the positioning marks 18 are less visible. In the case of the protective layer 17 formed of inorganic paste containing particles by screen printing, the surface roughness is significant, and the protective layer 17 is whiter and opaquer.

The holder 30 is a molding formed by molding synthetic resin. As shown in FIG. 7, the holder 30 has a slot 31 formed therein, and through-holes 32 extending from the bottom surface of the slot 31 to the lower side (Z2 side) surface of the holder 30. As shown in FIG. 8, the holder 30 further has reference portions 33. In this embodiment, the reference portions 33 are holes (see FIG. 10).

The heater unit 10 is bonded into the slot 31 of the holder 30 with an adhesive. At this time, positioning can be performed in advance while viewing the positioning marks 18 of the heater unit 10 through the through-holes 32 from the second surface 11*b* side of the substrate 11.

Since the first positioning marks 18*a* of the heater unit 10 are formed in the same step as the heat generator 16, the positional relationship with the heat generator 16 is fixed. Therefore, highly precise positioning relative to the heat generator 16 is performed by aligning the first positioning marks 18*a* with the reference positions. Since the second positioning marks 18*b* of the heater unit 10 are formed in the same step as the electrodes 15, the positional relationship with the electrodes 15 is fixed. Since the electrodes 15 are formed so as to be located at both longitudinal ends of the heat generator 16, highly precise positioning relative to the electrodes 15 is performed by aligning the second positioning marks 18*b* with the reference positions.

The slot 31 of the holder 30 is formed larger than the outline of the heater unit 10 in plan view shown FIG. 3, and the position of the heater unit 10 can be fine-tuned in the X1-X2 direction and the Y1-Y2 direction. In addition, the position of the heater unit 10 can be fine-tuned in the rotation direction within that margin range. Thus, fine tuning is performed such that the first positioning marks 18*a* and the second positioning marks 18*b* viewed through the through-holes 32 shown in FIGS. 9 and 10 are located at desired positions relative to the reference portions 33 of the holder 30, and the relative positions of the heater unit 10 and the holder 30 is thereby determined. For example, the reference portions 33 of the holder 30 are fixed to a jig, and a worker performs fine tuning such that the heater unit 10 is located at a predetermined position relative to the reference portions 33 while observing from the lower side using a microscope. Then, the heater unit 10 is fixed with adhesive so that the heater unit 10 is not displaced. Although not shown in FIGS. 9 and 10, the adhesive is applied to the bonding surfaces of the heater unit 10 and the holder 30. In the case where the adhesive is applied to the lower surface of the heater unit 10 and the upper surface of the holder 30, position adjustment is performed, for example, after the adhesive is applied and before the adhesive cures. In the case of a thermosetting adhesive, the adhesive is hardened by heating after the position adjustment, with the heater unit 10 temporarily fixed so as not to be displaced.

Since the holder 30 has reference portions 33, the heater 1 of this embodiment can be precisely attached to the external device 100. Since the heater unit 10 is positioned using the reference portions 33 of the holder 30 as references, the heat generator 16 can be highly precisely positioned without performing position adjustment while checking the positions of the heat generator 16 and the positioning marks 18 when incorporating the heater 1 into the external device 100. Alternatively, position adjustment may be performed, without using the reference portions 33, directly relative to the reference positions of the external device 100 while viewing the positioning marks 18 through the through-holes 32 of the holder 30 when attaching the heater 1 to the external device 100.

The positioning marks 18 are formed between the protective layer 17 and the substrate 11. The protective layer 17 looks white owing to the surface roughness of the upper side (Z1 side) thereof and the particles contained therein. Therefore, the positioning marks 18 are difficult to check from the upper side (Z1 side). Since the substrate 11 of the heater 1 of this embodiment is formed of a transparent material, the positioning marks 18 can be clearly checked from the second surface 11*b* of the substrate 11. Since the through-holes 32 of the holder 30 of the heater 1 of this embodiment are formed at positions coincident with the positioning marks 18 in plan view, the positioning marks 18 are visible from the lower side (Z2 side) of the holder 30. In addition, since the substrate 11 is flat and smooth, the positioning marks 18 looks flat and smooth when the positioning marks 18 formed on the first surface 11*a* of the substrate 11 is viewed from the second surface 11*b*. Since the interface between each positioning mark 18 and the first surface 11*a* of the substrate 11 is flat and smooth, the outlines of the positioning marks 18 observed through the through-holes 32 from the lower side (Z2 side) of the holder 30 can be clearly distinguished without being affected by the scattering of light or the like. In addition, since the surface roughness of the upper side (Z1 side) of the protective layer 17 and the particles contained in the protective layer 17 render the background of the positioning marks 18 observed from the Z2 side of the holder 30 white and opaque, the outlines of the positioning marks 18 are rendered clearer. Therefore, the heater 1 can be precisely positioned.

The positioning marks 18 each include a first positioning mark 18*a* corresponding to the position of the heat generator 16 and a second positioning mark 18*b* corresponding to the positions of the electrodes 15. This configuration makes it possible to more reliably position the heat generator 16 in the feed direction and the electrodes 15 in the longitudinal direction.

Advantageous effects of this embodiment will be described below.

The heater 1 of this embodiment includes a heater unit 10 and a holder 30 to be attached to an external device 100. The heater unit 10 includes a flat and smooth substrate 11, a linear heat generator 16 provided on a first surface 11*a* of the substrate 11, a plurality of electrodes 15 that supply power to the heat generator 16, and a protective layer 17 formed so as to cover the heat generator 16 and the electrodes 15. A second surface 11*b* of the substrate 11 is bonded to the holder 30. The substrate 11 is formed of a transparent material. A plurality of positioning marks 18 for determining the relative positions of the heater unit 10 and the holder 30 are formed on the first surface 11*a* of the substrate 11. The holder 30 has through-holes 32 formed at positions opposite to the positioning marks 18.

This configuration makes it possible to observe the positioning marks 18 provided on the first surface 11*a* of the substrate 11 formed of a transparent material through the through-holes 32 of the holder 30. In addition, since the substrate 11 is flat and smooth, and the interface between each positioning mark 18 and the substrate 11 is flat and smooth, the positioning marks 18 are clearly visible without being affected by the scattering of light when the positioning marks 18 formed on the first surface 11*a* of the substrate 11 is viewed from the second surface 11*b*. The precision of positioning when incorporating the heater 1 into the external device 100 is thereby improved.

In the heater 1 of this embodiment, the holder 30 has reference portions 33 used as references for attachment to the external device 100. This configuration makes it possible to attach the heater 1 precisely by aligning the positioning marks 18 with the reference portions 33 of the holder 30 in advance and thereby aligning the reference portions 33 of the holder 30 with the external device 100.

In the heater 1 of this embodiment, the positioning marks 18 are formed between the protective layer 17 and the substrate 11. Owing to this configuration, the lower surfaces of the positioning marks 18 provided on the flat and smooth substrate 11 are flat and smooth surfaces, and therefore the outlines of the positioning marks 18 observed from the lower side of the holder 30 can be clearly distinguished without being affected by the scattering of light or the like. Therefore, the heater 1 can be precisely positioned.

In the heater 1 of this embodiment, the positioning marks 18 each include a first positioning mark 18*a* corresponding to the position of the heat generator 16 and a second positioning mark 18*b* corresponding to the positions of the electrodes 15. This configuration makes it possible to more reliably position the heat generator 16 in the feed direction and the electrodes 15 in the longitudinal direction.

In the heater 1 of this embodiment, the first positioning marks 18*a* are formed in the same step as the heat generator 16, and the second positioning marks 18*b* are formed in the same step as the electrodes 15. Owing to this configuration, the positional relationship between the first positioning marks 18*a* and the heat generator 16 is accurate, and the positional relationship between the second positioning marks 18*b* and the electrodes 15 is accurate, and therefore positioning can be precisely performed.

In the heater 1 of this embodiment, the protective layer 17 is a thick film formed by screen printing. Owing to this configuration, surface roughness due to a mesh of a printing plate is left on the protective layer 17 formed by screen printing, therefore light is scattered, the background of the positioning marks 18 looks white and opaque when viewed from the second surface 11*b*, and therefore the positioning marks 18 can be observed more clearly.

In the heater 1 of this embodiment, the protective layer 17 contains particles. This configuration renders the protective layer 17 whiter and opaquer, and therefore the positioning marks 18 can be observed much more clearly.

In the heater 1 of this embodiment, the external device 100 is a toner fixing device. Owing to this configuration, the heat generator 16 in the toner fixing device can be accurately positioned, and therefore heating efficiency is improved.

Although the heater 1 of the first embodiment of the present invention has been described specifically, the present invention is not limited to the above-described embodiment, and various changes may be made therein without departing from the spirit of the present invention. The embodiment of the present invention may be modified, for example, as follows, and these are also included in the technical scope of the present invention.

Figure 11:
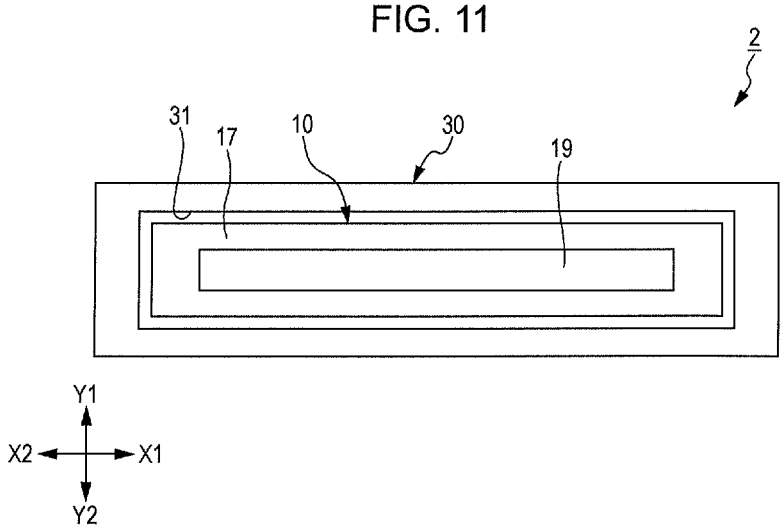
FIG. 11 is a schematic plan view of a heater of a modification as viewed from the Z1 side shown in FIG. 2.
Figure 12:
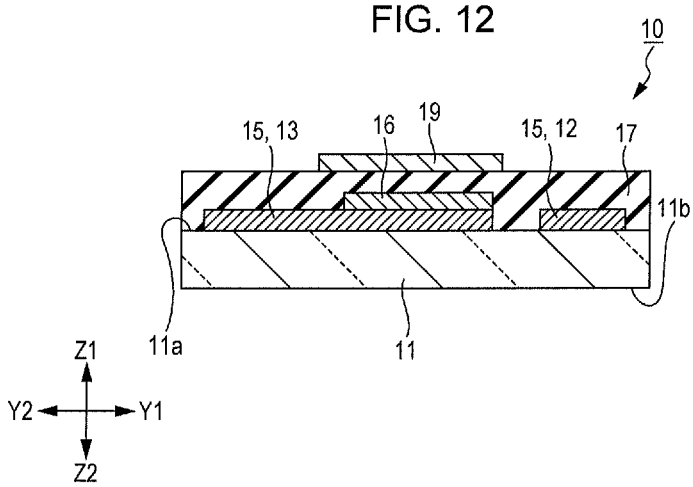
FIG. 12 is a sectional view at the same position as FIG. 5 in the modification.
Figure 13:
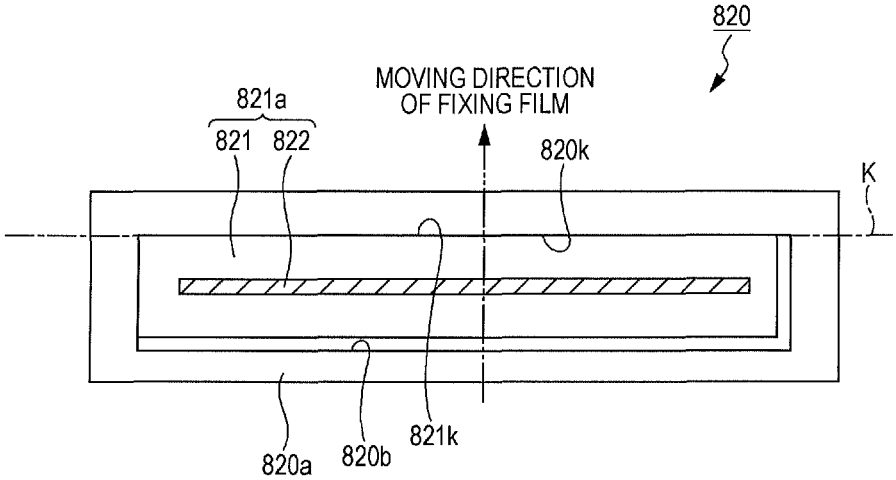
FIG. 13 is a plan view showing the configuration of a heating element described in Japanese Unexamined Patent Application Publication No. 2-157886.
Figure 14:
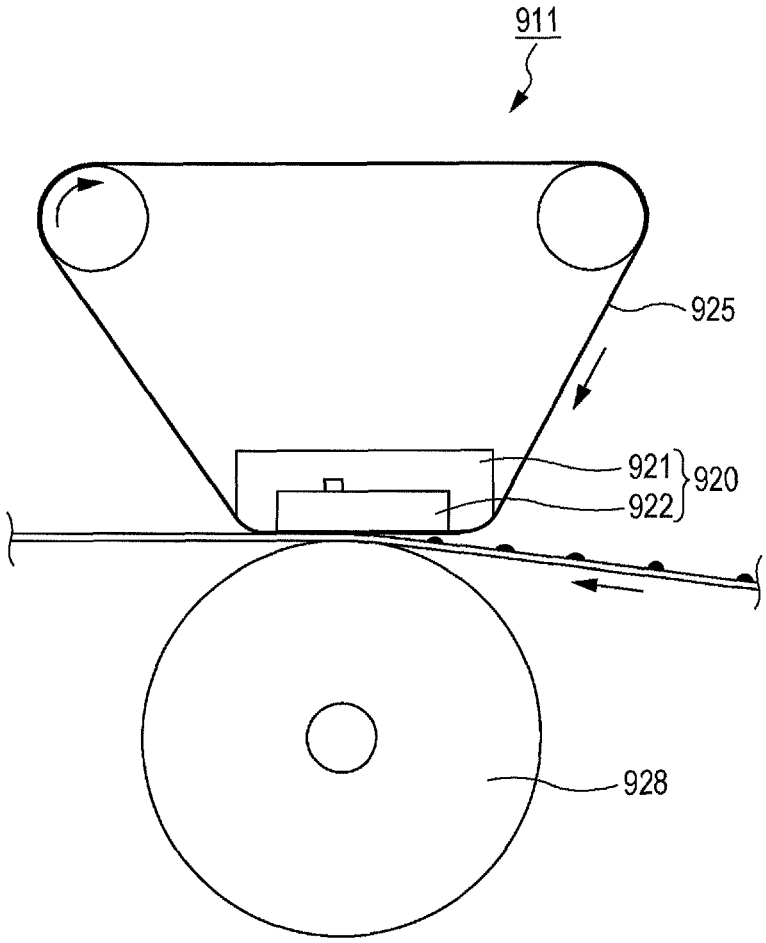
FIG. 14 is a sectional view showing the schematic configuration of a fixing device described in Japanese Unexamined Patent Application Publication No. 9-068877.
Figure 15:
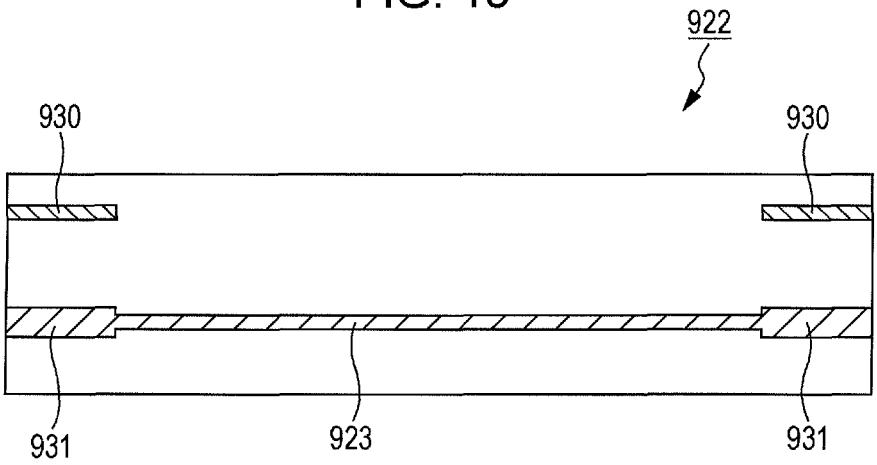
FIG. 15 is a bottom view showing a heater substrate of a heating element described in Japanese Unexamined Patent Application Publication No. 9-068877.

(1) In this embodiment, the protective layer 17 is the uppermost layer. However, as shown in FIGS. 11 and 12, a heat transfer layer 19 may be provided on the upper surface of the protective layer 17. FIG. 11 is a schematic plan view of a heater 2 of a modification as viewed from the upper side (Z1 side) shown in FIG. 2. FIG. 12 is a sectional view at the same position as FIG. 5. The heater 2 of the modification is the same as the heater 1 except that the heat transfer layer 19 is provided on the upper surface of the heater unit 10. The heat transfer layer 19 is formed so as to cover the heat generator 16 in plan view, in a larger area. The heat transfer layer 19 is preferably formed of a material having high heat conductivity and high impact resistance. The possibility that the protective layer 17 is damaged by thermal shock is reduced, and the durability of the heater 2 is thereby improved.

(2) In this embodiment, the electrodes 15 are conductive coating films collectively formed by screen printing. However, the electrodes 15 may be formed in two operations: a screen printing operation to form the comb-shaped electrodes 12*b* and the L-shaped electrodes 13*b*, and a screen printing operation to form the comb-shaped electrode 12*a* and the L-shaped electrodes 13*a*. The comb-shaped electrode 12*a* and the L-shaped electrodes 13*a* may be formed in separate screen printing operations. In these cases, the second positioning marks 18*b* may be collectively formed in the screen printing operation to form the comb-shaped electrodes 12*b* and the L-shaped electrodes 13*b*.

(3) In this embodiment, the positioning marks 18 are formed one on each of the X1 side and the X2 side. However, the positioning marks 18 may be formed at two locations on the Y1 side and the Y2 side. By performing position adjustment using positioning marks 18 at a total of four locations, positioning can be performed more precisely. Similarly, the reference portions 33 of the holder 30 may be provided at four locations for position adjustment. Although the positioning marks 18 are formed in a cross shape, the shape of the positioning marks 18 is not limited to this, and the positioning marks 18 may have any shape as long as positioning is possible. Similarly, although the reference portions 33 of the holder 30 are holes, the present invention is not limited to this, and the reference portions 33 may be slots or protrusions.

What is claimed is:

1. A heater comprising:

a heater unit including a flat and smooth substrate, a linear heat generator provided on a first surface of the substrate, a plurality of electrodes configured to supply power to the heat generator, and a protective layer disposed to cover a part of each of the electrodes and the heat generator; and a holder, a second surface of the substrate being bonded to the holder, the holder being attached to an external device, wherein the substrate is formed of a transparent material, a plurality of positioning marks for determining relative positions of the heater unit and the holder are disposed on the first surface, and the holder has through-holes formed at positions opposite to the positioning marks.

2. The heater according to claim 1, wherein the holder has reference portions used as references for attachment to the external device.

3. The heater according to claim 1, wherein the positioning marks are disposed between the protective layer and the substrate.

4. The heater according to claim 1, wherein the positioning marks each include a first positioning mark corresponding to the position of the heat generator and a second positioning mark corresponding to the positions of the electrodes.

5. The heater according to claim 1, wherein the protective layer contains glass particles.

6. The heater according to claim 1, wherein the external device comprises a toner fixing device.

7. A method of forming a heater comprising:

providing a heater unit including a flat and smooth substrate made of a transparent material;

providing a linear heat generator on a first surface of the substrate;

providing a plurality of electrodes configured to supply power to the heat generator;

forming a protective layer so as to cover a part of each of the electrodes and the heat generator;

providing a holder and bonding a second surface of the substrate to the holder;

attaching the holder to an external device;

forming a plurality of positioning marks for determining relative positions of the heater unit and the holder on the first surface; and forming through-holes in the holder at positions opposite to the positioning marks.

8. The method according to claim 7, comprising:

forming reference portions on the holder; and using the reference portions as references for attachment to the external device.

9. The method according to claim 7, comprising:

positioning marks between the protective layer and the substrate.

10. The method according to claim 7, wherein the positioning marks each include a first positioning mark corresponding to the position of the heat generator and a second positioning mark corresponding to the positions of the electrodes.

11. The method according to claim 10, comprising:

forming the first positioning marks in the same step as the heat generator; and forming the second positioning marks in the same step as the electrodes.

12. The method according to claim 7, comprising:

forming the protective layer by screen printing.

13. The method according to claim 7, wherein the protective layer contains glass particles.

14. The method according to claim 7, wherein the external device comprises a toner fixing device.

* * * * *